United States Patent [19]

Winkler et al.

[11] 4,420,153

[45] Dec. 13, 1983

[54] DOCUMENT HANDLING COUNTING AND EXAMINING DEVICE INCORPORATING HIGH SPEED ROTARY GATING MEANS

[75] Inventors: Theodore Winkler, Levittown; Frank J. Reed, Philadelphia, both of Pa.

[73] Assignee: Brandt, Inc., Bensalem, Pa.

[21] Appl. No.: 188,906

[22] Filed: Sep. 19, 1980

[51] Int. Cl.[3] ..... B65H 29/60

[52] U.S. Cl. ..... 271/304; 271/202; 271/315

[58] Field of Search ..... 209/534, 555, 556, 655, 209/656, 654, 599, 699; 271/303, 304, 273, 274, 187, 315, 202, 270; 198/367, 442

[56] References Cited

U.S. PATENT DOCUMENTS

| | | | |
|---|---|---|---|
| 1,825,217 | 9/1931 | Tufts et al. | 271/303 |
| 2,526,916 | 10/1950 | Turrall . | |
| 2,563,498 | 8/1951 | Skinner . | |
| 3,166,313 | 1/1965 | Rehm . | |
| 3,205,741 | 9/1965 | Haselow . | |
| 3,265,208 | 8/1966 | Reniker et al. | 209/655 X |
| 3,327,850 | 6/1967 | Simmons . | |
| 3,426,879 | 2/1969 | Walker | 209/534 X |
| 3,472,506 | 10/1969 | Rabinow et al. | 271/304 |
| 3,759,382 | 9/1973 | Walkley et al. | 209/534 |
| 3,847,384 | 11/1974 | Bethke | 271/187 X |
| 3,894,479 | 7/1975 | Anikanov et al. | 271/303 X |
| 4,251,000 | 2/1981 | Templeton | 271/303 X |
| 4,275,874 | 6/1981 | DiBlasio | 271/187 X |
| 4,277,061 | 7/1981 | Nagel et al. | 271/303 X |
| 4,373,713 | 2/1983 | Loebach | 271/303 |

*Primary Examiner*—Robert B. Reeves

*Assistant Examiner*—Edward M. Wacyra

*Attorney, Agent, or Firm*—Weinstein & Sutton

[57] ABSTRACT

Document handling apparatus for determing the fitness of documents such as paper sheets, paper currency and the like and including a feed mechanism for feeding documents in a single file through an examining location. Documents pass through the examining location and are examined for relative limpness or stiffness, density (i.e. clean or dirty,), perforations, cuts, tears, holes and the like, missing and/or folded corners and a test for document genuineness. Based upon the results of the tests, the sheets, which are still moving at high speed in a single file after examination, are directed toward a rotatably mounted gating roller which, dependent upon the condition of the examined sheets, is rotated either in a clockwise or counterclockwise direction, at extremely high speed, to deflect sheets toward either of two possible output paths. The gating roller may be either a continuous or dicontinuous member. Sheets, after undergoing deflection, are collected by associted output stackers, which include feeding and guiding belts for guiding the sheets and aiding in the insertion of the sheets into a rotary stacker member, and stripping and guiding belts for stripping sheets from the rotary stacker member and for driving sheets to the supporting surface of a stacker plate to facilitate formation of a neat, compact stack. The gating roller may have a continuous or discontinuous surface, preferably of low mass, to facilitate rapid acceleration and deceleration thereof, and may be utilized with control circuitry to advance sheets towards one of the three possible paths.

39 Claims, 28 Drawing Figures

Figure 1:
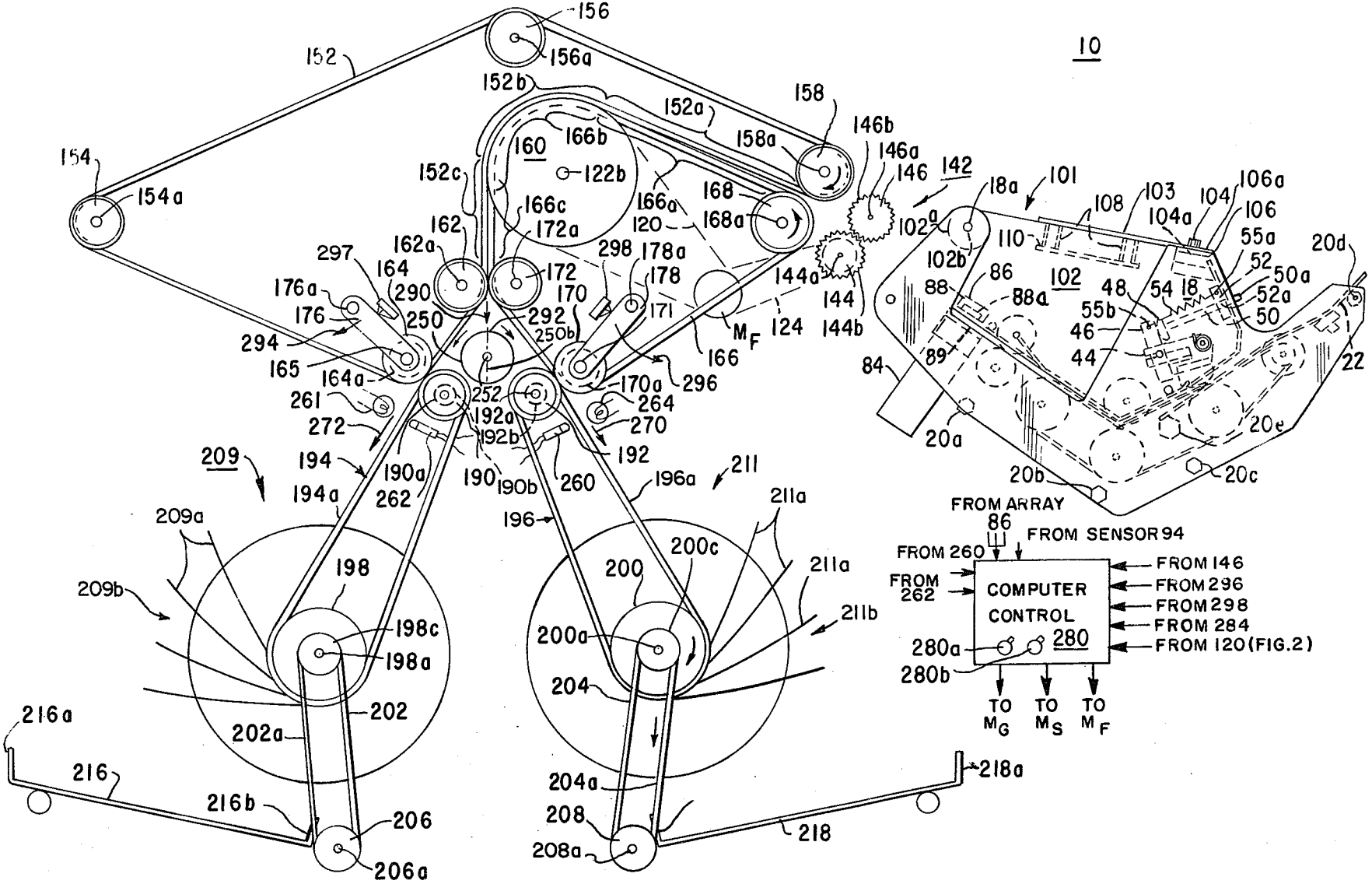

DOCUMENT HANDLING COUNTING AND EXAMINING DEVICE INCORPORATING HIGH SPEED ROTARY GATING MEANS

FIELD OF THE INVENTION

The present invention is related to document handling apparatus and more particularly to novel, high speed document handling apparatus capable of delivering sheets from a stack in single file to an examining station for examining sheets to determine their condition and for diverting sheets to an appropriate output stacker dependent upon the examined condition of said sheets.

BACKGROUND OF THE INVENTION

Document handling apparatus is presently available and is in widespread use for performing operations such as counting and endorsing sheets continuously at high speed and without interruption such as, for example, counting sheets, food stamps, coupons, checks and the like and cancelling items such as, for example, checks, food stamps, coupons and the like. These operations generally lend themselves to being performed continuously at high speed and without interruption. Equipment suitable for performing the aforesaid operations is described, for example, in U.S. Pat. Nos. 3,771,783 issued Nov. 13, 1973 and U.S. Pat. No. 3,944,210 issued Mar. 16, 1976, both of which patents are assigned to the assignee of the present invention. The apparatus described in these patents teaches a technique for receiving a stack of sheets in an infeed hopper, moving the sheets in a single file fashion past a counting and/or endorsing station and thereafter stacking the counted and/or endorsed sheets in an output stacker. So long as documents are presented to the infeed hopper, the operation can be performed continuously and without interruption.

However, the requirements within the area of document handling make it extremely advantageous to be able to examine documents and sort them according to certain criteria such as genuine or suspect; clean or dirty; too stiff or too limp (typically due to extensive use and handling); having perforations or cuts; having torn or folded corners; and the like. Equipment presently available for handling and examining documents typically is designed to continuously and without interruption, feed and stack sheets meeting certain criteria for acceptable documents and to halt the sheet feeding operation upon the examination of a sheet failing to meet the criteria for acceptability and to cause the last sheet fed to the output stacker to be the unfit sheet. Assuming that the number of unfit sheets per total number of examined sheets is quite small, say one per thousand or one per five thousand, interruptions of this nature are quite insignificant. However, in the event that the sheets being examined alternate between fit and unfit status, for example, the number of interruptions in the document feeding process of the above mentioned design is excessive, rendering the equipment totally impractical for use. Manual performance of the examination procedure is an alternative to present-day equipment, but is impractical due to the fact that the operation is quite slow and quite tedious.

BRIEF DESCRIPTION OF THE INVENTION

The present invention is characterized by comprising a high speed rotary gating assembly for deflecting sheets and the like at very high speeds between two or more outfeed paths, wherein the operating speeds of the rotary gating assembly permit sheet handling, examination and stacking to be performed substantially without interruption and at no reduction in speed as compared with the operating speeds of document handling devices presently in use for counting and/or endorsing documents.

The present invention is comprised of an infeed hopper for receiving a stack of sheets, which may for example be food coupons, paper currency, checks and the like. Feed means advance each sheet one at a time from the stack whereby the sheets pass through an examination location where they are examined for any one or more of a variety of different conditions.

The conditions which may be determined are density (i.e. clean or dirty); holes, cuts or perforations; torn or folded corners; relative limpness or stiffness and authenticity (i.e. authentic or "suspect"). Means are provided to select as few as none of the tests and as many as all of the tests, depending upon the needs of the particular user.

Based upon the examinations being performed, the sheets which are moved through the examining stations in single file and at high speed are delivered to gating roller means for deflection to an appropriate output path for suitable stacking.

The gating roller may assume a variety of forms such as, for example, a generally cylindrical shaped member having a continuous periphery; a single bent wire or plurality of bent wires having at least a portion thereof designed to revolve about an imaginary circular path at an extremely high rpm (revolutions per minut) in order to properly deflect documents. The rotary gating member is preferably of low mass to facilitate its rapid acceleration and deceleration to permit the rotatable gating apparatus to rapidly change its direction of rotation as frequently as the intervals between successive documents, for example.

Deflected sheets are caused to move along a path having one surface thereof defined by a moving belt which serves to urge each sheet deeply into a pocket of a stacker wheel. A second moving belt assembly associated with said stacker wheel serves to strip sheets from the stacker wheel and further engages the leading edges of said sheets for urging the sheets toward a stacker output in order to stack the sheets in a neat, uniform and compact manner.

Control means for controlling the operation of the gating means is designed to operate at a speed commensurate with the operating speed of the apparatus by deriving timing pulses directly from the feed motor. Detector means are provided for assuring the proper routing of sheets and for halting operation of the equipment in the event that sheets are improperly routed in order to protect both the sheets and the equipment from being damaged as a result of improper operation or jamming.

The rotary gating apparatus, in one embodiment, is further capable of routing sheets towards as many as three paths through the use of a unique rotary gating design together with control electronics to assure proper alignment thereof.

OBJECTS OF THE INVENTION AND BRIEF DESCRIPTION OF THE FIGURES

It is, therefore, one object of the present invention to provide a novel document handling apparatus capable of routing sheets being handled thereby to one of a plurality of paths without interruption of the normal handling operation and no decrease in normal operating speed.

Still another object of the present invention is to provide novel apparatus for handling and examining documents, including means for routing sheets to one of a plurality of output stackers depending upon the examined conditions of said sheets.

Still another object of the present invention is to provide novel gating means for diverting sheets to a selective one of a plurality of possible paths and which is capable of diverting successively fed sheets to different routes and without suffering any reduction in the linear speeds at which the sheets are moved through the handling apparatus.

Still another object of the present invention is to provide a novel outfeed stacker apparatus for receiving documents routed thereto and incorporating belt means for guiding sheets and urging them into a pocket provided within a stacker wheel assembly.

Still another object of the present invention is to provide a novel apparatus for stacking sheets delivered thereto and comprising a moving belt assembly cooperating with a stacker wheel assembly for stripping sheets from the pockets of said stacker wheel assembly and for urging the edges of the sheets engaging said moving belt assembly toward the stacker plate to form a neat, compact stack.

Still another object of the present invention is to provide a novel gating apparatus comprising gating means of extremely low mass capable of high switching speeds for diverting sheets to one of a plurality of possible routes, enabling sheets to be delivered at high speed and without interrupting the normal handling operation.

The above as well as other objects of the present invention will become apparent when reading the accompanying description and drawings in which:

FIG. 1 shows a plan view of document handling apparatus incorporating the principles of the present invention.

Figures 1A, 1B, 1C:
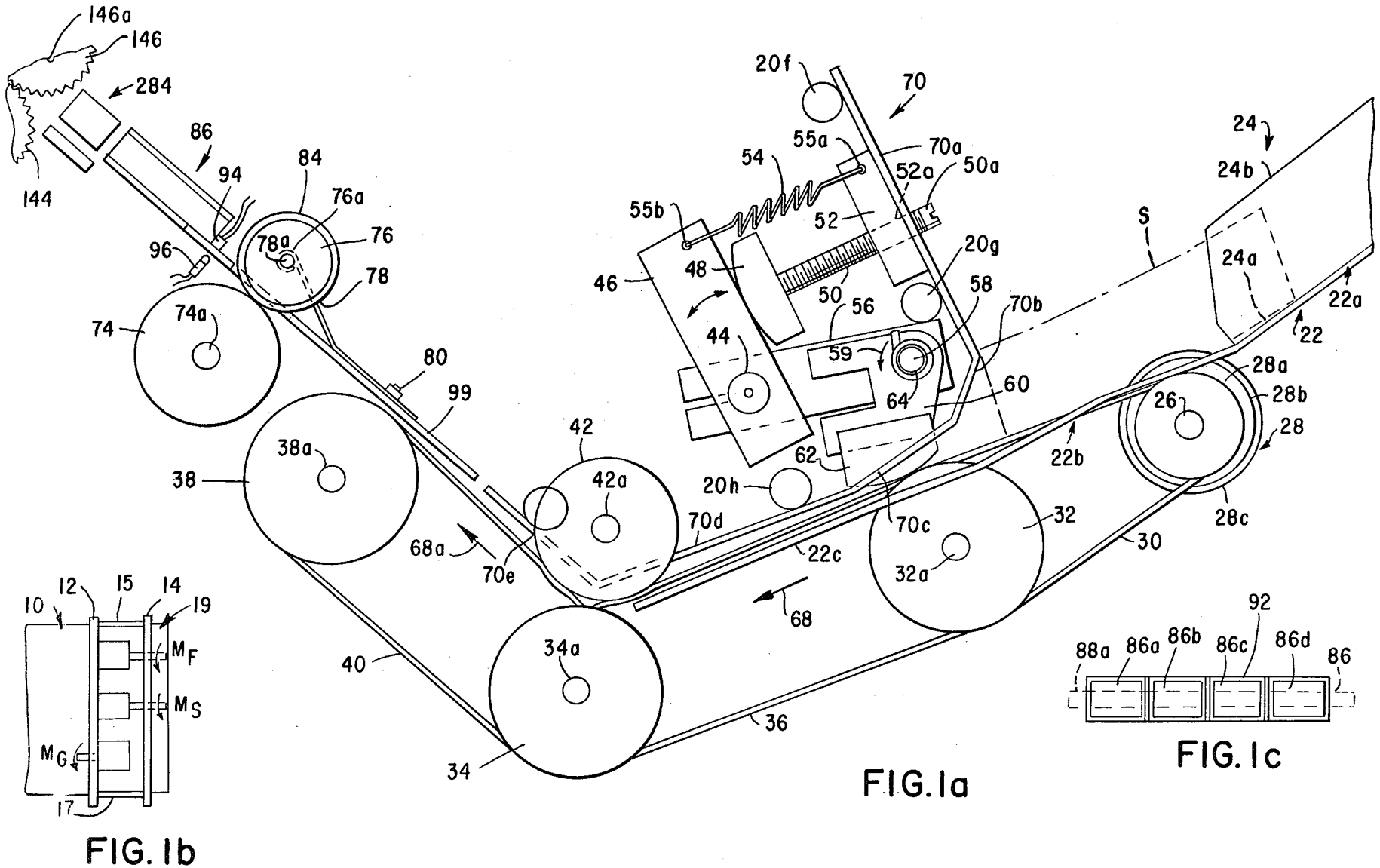

FIG. 1*a* shows a detailed view of the document feeding and examining portion of the apparatus shown in FIG. 1.

Figure 2:
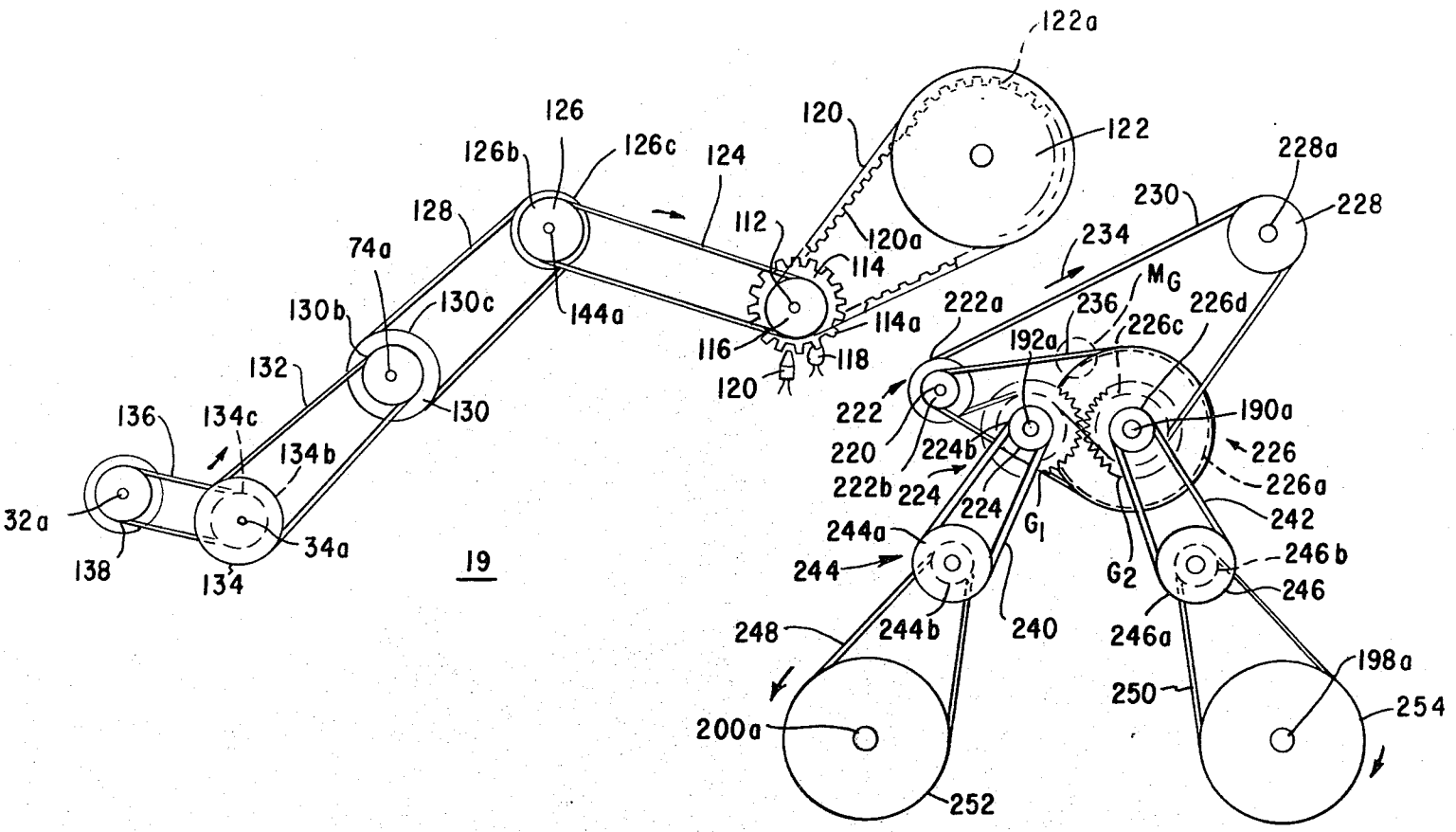

FIG. 1*b* shows a simplified plan view of the supporting structure for supporting the apparatus shown in FIG. 1 and the apparatus shown in FIG. 2.

FIG. 1*c* is a plan view of the sensor array of FIG. 1.

FIG. 2 is a plan view showing the drive chain utilized for driving the document feeding, routing and stacking apparatus of FIG. 1.

Figure 3A:
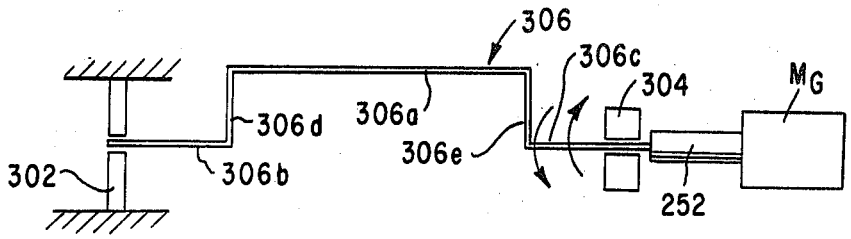
Figure 3B:
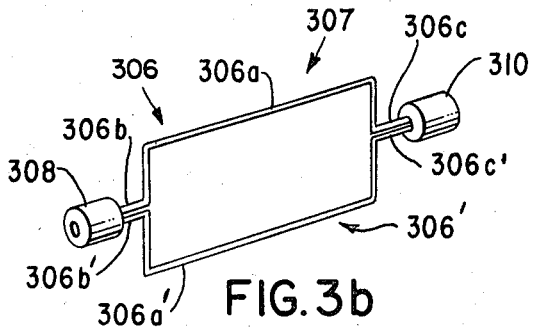
Figure 3C:
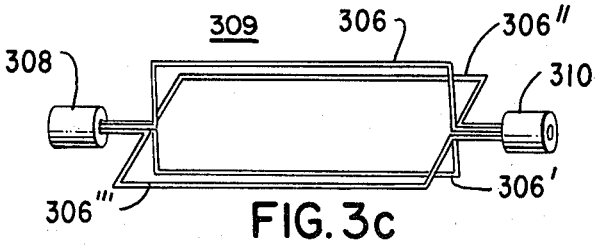

FIGS. 3*a* through 3*c* show alternative embodiments for the gating roller employed in the document handling apparatus of FIG. 1.

Figure 4:
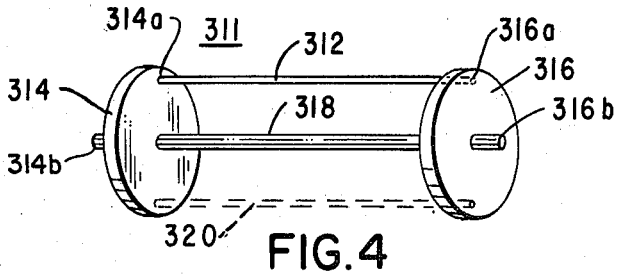

FIG. 4 shows still another rotary gating apparatus embodiment of the present invention.

Figure 5:
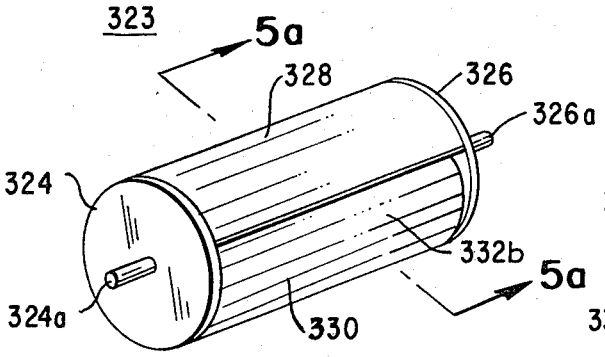
Figure 5A:
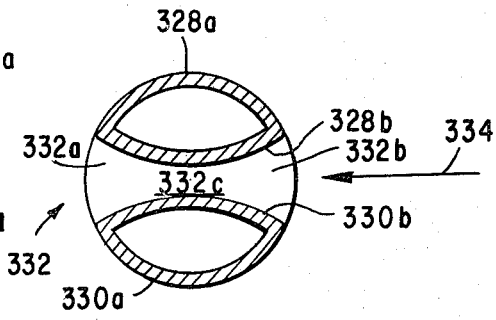

FIGS. 5 and 5*a* show a perspective view and a sectional view of still another gating roller apparatus of the present invention.

FIGS. 6*a* through 6*h* show various forms which may be substituted for the bent wire gating means of FIGS. 3*a* through 3*c*.

Figure 7:
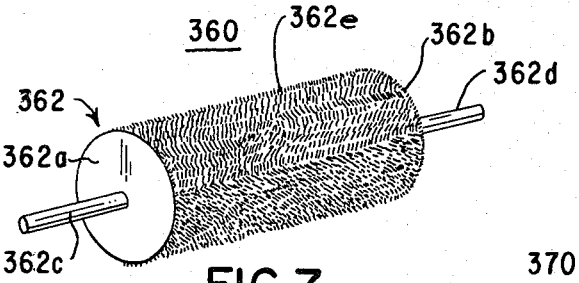
Figure 7A:
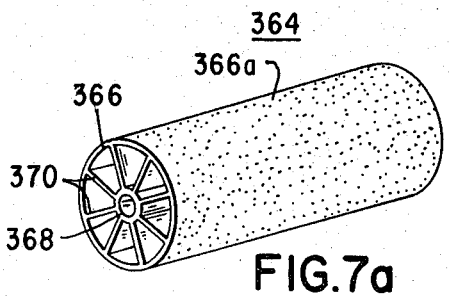
Figure 7B:
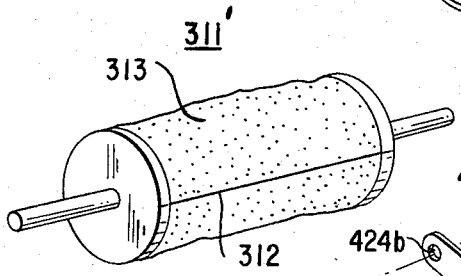
Figure 7C:
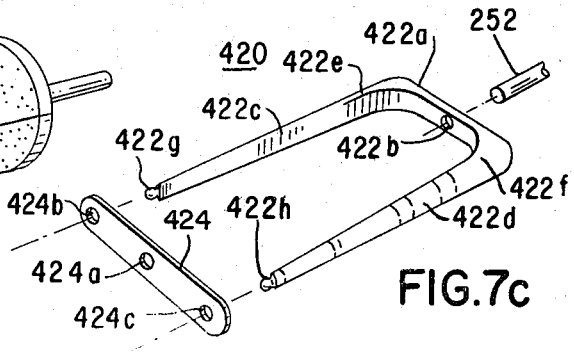
Figure 7D:
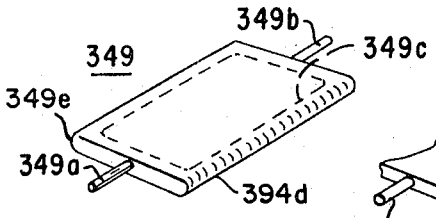
Figure 7E:
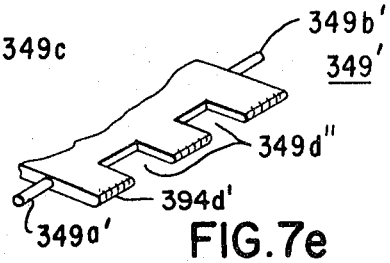

FIGS. 7 through 7*e* show perspective views of other gating roller embodiments of the present invention.

Figure 8:
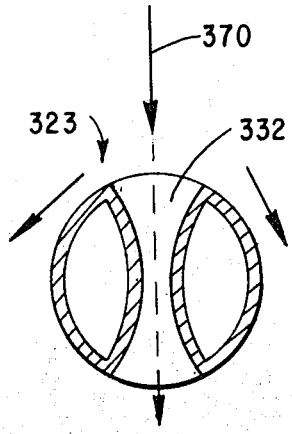

FIG. 8 is a simplified end view showing the manner in which the gating roller embodiment of FIG. 5 may be employed for the purpose of routing sheets.

Figure 8A:
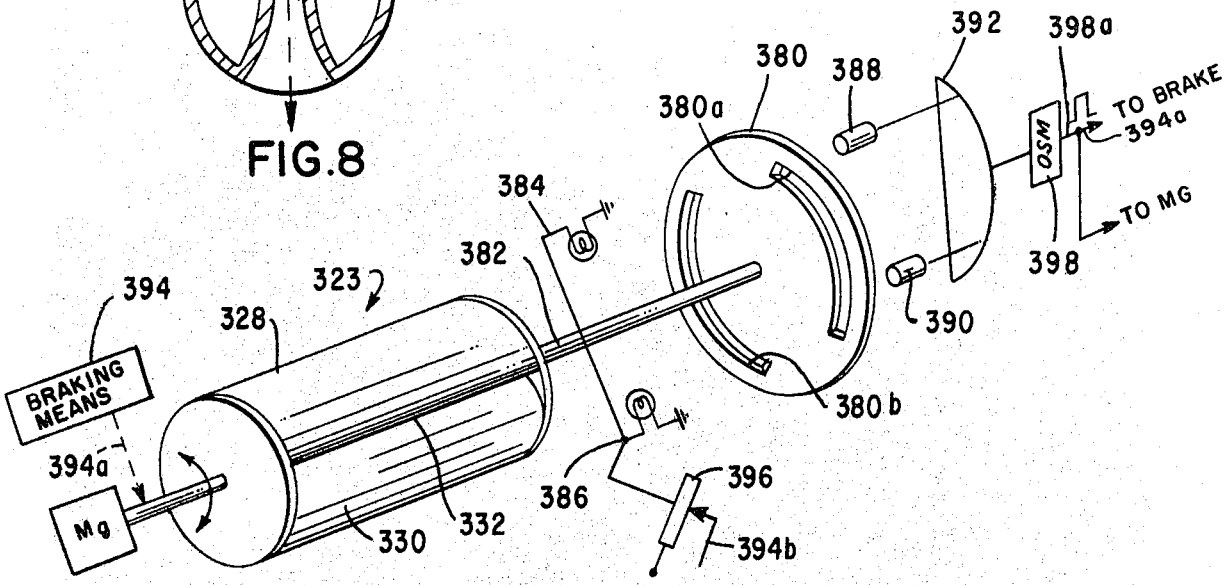

FIG. 8*a* shows apparatus for use with a gating roller of the type shown in FIG. 5 which may be utilized to permit documents to move along an undeflected path.

Figure 8B:
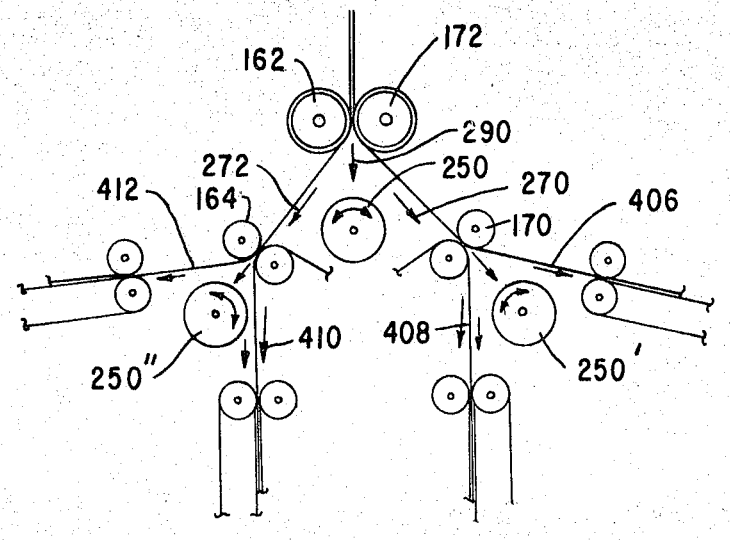

FIG. 8*b* shows a simplified plan view of the manner in which a plurality of gating rollers may be employed to divert sheets to a selected one of a large plurality of routes.

DETAILED DESCRIPTION OF BEST MODE OF THE INVENTION AND ALTERNATIVE EMBODIMENTS THEREOF

Considering FIGS. 1, 1*a*, 1*b* and 2, there is shown therein a document handling, examining and counting apparatus 10 embodying the principles of the present invention. FIG. 1 shows the paper handling and examining apparatus, while FIG. 2 shows the drive train and all interconnected components thereof which drive the belts, rollers and like which constitute the aforesaid paper handling portion of the inevntion. As shown in simplified form in FIG. 1*b*, a pair of large plates 12 and 14 are arranged in spaced parallel fashion and although only two spacer members 15 and 17 are shown, it should be understood that at least four such spacer members, one being provided in each corner, are utilized to maintain plates 12 and 14 in spaced, parallel fashion.

Plates 12 and 14 are provided with openings of suitable size and which are suitably positioned to allow clearance for all rotating shafts and the like to be extended therethrough. The region between plates 12 and 14 is utilized to mount the feed motor Mf, stacking motor Ms and gate motor Mg therebetween, as well as some electronic components, which have been omitted from FIG. 1*b* for purposes of simplicity. The shafts of these motors extend through suitable openings provided in plate 14 and are coupled to suitable gears, pulleys and the like, as will be more fully described hereinbelow.

FIG. 1 shows the sheet feeding portion of the apparatus 10 and the plane of FIG. 1 may be considered to be the front plate 12. Similarly, FIG. 2 shows all of the drive chain assemblies for driving the paper feed mechanisms of FIG. 1 and the plane of FIG. 2 may be considered to be plate 14.

The sheet feeding mechanism 10 is comprised of a large, irregularly shaped plate 18 which is mounted by suitable mounting means such as rods 20*a* through 20*e* which are secured to the face of plate 12 and extend outwardly therefrom and in turn have plate 18 secured thereto by suitable fastening members such as tapped fasteners. Plate 18 cooperates with plate 12 to serve as cover means for the mechanisms arranged therebetween. Plate 18 and spacers and supports 20*d* and 20*e* serve as the means for positioning and supporting an elongated plate 22 which functions as both an infeed hopper and a guideplate for guiding sheets through the apparatus. The upper end 22*a* of plate 22 supports a substantially C-shaped channel 24 whose base portion 24*a* rests upon the upper surface of plate 22 and whose upright arms (only arm 24 being shown in FIG. 1*a*) extend upwardly therefrom, to serve as a means for receiving a stack S of sheets to be processed by apparatus 10, said stack S being supported between the aforesaid upright arms and upon surface 24*a*.

The sheets are supported by portion 22*a* and the next adjacent portion 22*b* of plate 22 and occupy the region generally as represented by the trapezoidal shaped dotted region S.

A shaft 26 supports an eccentric picker roller assembly 28 mounted to rotate upon shaft 26 and having a central eccentric portion 28*a* and opposing concentric outwardly extending ends. Only end section 28*b* and central section 28*a* are shown in FIG. 1*a* for purposes of simplicity. The outer ends each have annular grooves about their periphery for supporting and receiving a resilient O-ring belt 30. As shown in FIG. 1*a*, O-ring belt 30 is entrained about the annular groove provided therefor in end section 28*b* of picker roller 28. The ends of roller 28 are concentric about shaft 26, while center portion is eccentric relative to shaft 26 as was mentioned hereinabove.

Resilient O-ring 30 is also entrained about a roller 32 having an annular shaped groove surrounding said roller and adapted to position and seat said O-ring. Although not shown for purposes of simplicity, a second annular groove is provided on the far end of roller 32 and has entrained therearound a second O-ring, similar to O-ring 30 and entrained about the opposite end projection of eccentric roller 28, which opposite projection has not been shown for purposes of simplicity.

A roller 34 is positioned downstream from roller 32 and is mounted to rotate about shaft 34*a*. Roller 32 is mounted to rotate about shaft 32*a*. Additional annular grooves, which are axially spaced from the previously mentioned grooves, are provided about the periphery of roller 32 to position and seat O-ring 36 and an additional O-ring (not shown). Cooperating grooves are provided at like locations about the periphery of roller 34 to seat the last-mentioned O-rings, only O-ring 36 being shown for purposes of simplicity. A roller 38 is positioned downstream from roller 34 and is mounted to rotate about shaft 38*a*. An O-ring 40 and a second O-ring (not shown) similar thereto are entrained about rollers 34 and 38 which are both provided with annular grooves for seating and positioning a pair of such O-rings, only one O-ring, namely O-ring 40, being shown in FIG. 1*a* for purposes of simplicity.

A roller 42 mounted to rotate about shaft 42*a* is positioned just above the surface of roller 34.

Plate 18 is provided with an opening for receiving shaft 44 (see FIGS. 1 and 1*a*). An elongated arm 46 is secured to shaft 44 and has its right-hand edge resting against the left-hand surface of member 48 which is secured to the left-hand end of threaded member 50. Member 50, which is a differential screw, threadedly engages a tapped opening 52*a* in a mounting block 52, secured to plate 18. Threaded member 50 is provided with a slotted end 50*a* for receiving the head of a screwdriver to facilitate its adjustment. A spring means 54 extends between a pin 55*a* provided on mounting block 52 and a pin 55*b* provided near the upper end of arm 46 for normally urging arm 46 clockwise about shaft 44. By adjusting threaded fastening member 50, the angulr orientation of arm 46 about its axis of rotation, i.e. the center of shaft 44, may be simply and readily adjusted.

Also pivotally mounted upon shaft 44 is an elongated stripper assembly supporting arm 56 which is locked to swing with shaft 44. The forward free end of mounting arm 56 is provided with a pin 58 for supporting swingable stripper support 60. A solid stripper member 62 is secured to the underside of swingable support member 60, typically by suitable fastening means (not shown). A torsion spring 64 has its opposing ends respectively secured to arm 56 and a swingable member 60, urging member 60 counterclockwise about the axis of pivot pin 58 relative to arm 56, as shown by arrow 59. Thus springs 54 and 64 tend to resiliently urge stripper member 62 into engagement with the adjacent portion of roller 32, while at the same time being yieldable to relieve a possible jam condition, i.e. to relieve the sudden build-up of a curled document or two or more overlapping documents which move between stripper member 62 and roller 32.

The confronting surfaces of members 62 and 32 have differing coefficients of friction whereby when a single document passes therebetween, the surface of roller 32 exerts the prevailing influence upon a single document, enabling the document to pass in the forward feed direction, as shown by arrow 68. In the event that two documents are simultaneously fed between members 62 and 32, the coefficient of friction between the two documents is substantially less than the coefficient of friction between the lower document and the surface of roller 32, allowing the lower document to move in the forward feed direction 68. The coefficient of friction between member 62 and the upper document is also greater than the coefficient of friction between the two documents causing the upper document to be impeded from moving in the forward feed direction, thereby stripping the overlapping sheets fed therebetween to substantially assure that the sheets will be fed in a single file past the position of the nip formed between members 62 and 32.

The support members 20*f*, 20*g* and 20*h* which substantially perform the same functions as support members 20*a* through 20*e*, in addition to supporting plate 18, support an upper plate 70 having a plurality of bends therein which define flat portions between said bends, said flat portions being designated 70*a* through 70*e*. Portions 70*a*, 70*b* and 70*c* cooperate with portions 22*a* and 22*b* of guideplate 22 to define a stacker region for supporting a stack S of sheets and further, to define a tapering entrance throat portion between plate portions 70*b*–70*c* and 22*b*.

Sheets in stack S which rise above portion 70*b* have their leading edges resting against plate portion 70*a* which serves to relieve the portion of the stack therebeneath from a part of the weight exerted on the stack S by sheets above the corner between portions 70*a* and 70*b*.

The central portion 28*a* of eccentric roller 28 is preferably fitted with a pair of O-rings to provide good frictional engagement between the O-rings and the bottommost sheet in the stack S of sheets. Only one such O-ring 28*c* is shown in FIG. 1*a* for purposes of simplicity. The eccentric portion 28*a* of roller 28, together with the last-mentioned O-rings, such as O-ring 28*c* serve to "jog" the stack upwardly and to exert a frictional force on the bottommost sheet, to drive the bottommost sheet in feed direction 68 to cause the sheet to be moved between members 62 and 32 for the feeding and stripping operations, as was described hereinabove.

Sheets moving past members 62 and 32 pass between plate portions 22*c* and 70*d* and are guided by the upper runs of O-rings 36 and 40 and the surface of roller 42, causing the sheets, being fed in single file, to undergo a change in direction, initially being fed generally diagonally downward as shown by arrow 68 to being fed generally diagonally upward as shown by arrow 68*a*. Roller 42, freewheeling mounted on shaft 42*a*, is arranged to smoothly guide sheets as they make the transition from being moved off of the upper run of O-ring 36 and on to the upper run of O-ring 40.

As sheets move along the upper run of O-ring 40 and pass over roller 38, the sheets are guided between the surface of roller 38 and guideplate portion 70*e* where they are caused to enter into the nip between roller 74 mounted to rotate upon shaft 74*a*, and idler rollers, such as roller 76.

The pair of idler rollers are resiliently positioned above roller 74 and are resiliently mounted by suitable leaf spring means. As shown for example in FIG. 1*a*, one such idler roller 76 is mounted to rotate about shaft 76*a* which is supported by the free end 78*a* of leaf spring 78 whose opposite end is secured to swingable plate 99 by fastening means 80, swingable plate 99 forming part of a swingably mounted unit 101, to be more fully described.

The surface speed of roller 74 exceeds the surface speed of roller 38, so that, as documents enter into the nip between rollers 76 and 74, they are abruptly accelerated to move at a higher linear velocity, causing the trailing edge of the document fed through the nip formed by rollers 74 and 76 to move a predetermined spaced distance from the leading edge of the next document to be fed to said nip, providing a gap between said trailing and leading edges sufficient to perform counting and other sensing operations on said sheets.

The roller 74 preferably has a surface with a high coefficient of friction. The rollers 76 are provided with grooves for receiving and supporting an O-ring, such as O-ring 84 to be assured that the accelerating force is imparted to sheets with a minimum of slippage.

Positioned immediately downstream of the acceleration roller 74 and idler roller 76 is a light source assembly 84 and a light sensor array 86. Light source 84 is comprised of a housing containing a lamp, preferably a halogen lamp (not shown). The cover plate 88 over the end of housing 84 adjacent to the feed path 68*a* is transparent. An opaque mask is provided upon the cover plate to enable only an elongated slit of light to be passed upwardly through transparent plate 88 toward the light sensor array 86. Array 86 is comprised of a plurality of sensors 86*a*–86*d* (FIG. 1*c*). The sensors in array 86 are arranged in an end to end fashion so as to be substantially aligned with the elongated slit 88*a* provided in transparent cover plate 88. A similar transparent cover plate 89 is provided across the bottom surface of array housing 84.

As shown best in FIG. 1*c*, the sensor array 86 is comprised of a housing aligned with an opening 92 in swingable plate 99 which opening 92 is divided into four compartments, each of which receives and supports the sensing surface 86*a* through 86*d* of an associated sensor element 86. As can be noted, each sensor surface has a rectangular shape. Elongated narrow dotted rectangle 88*a* represents the slit provided in the mask formed over the upper end of the light source housing 84 to define the region over which light is emitted from the light source assembly 84 and toward the light sensor array 86.

A preview sensor 94 is positioned above an opening in plate portion 70*e* and cooperates with a light source, preferably an LED 96, to function as a preview sensor for a purpose to be more fully described.

The swingable plate portion 99 upon which the idler rollers, such as idler roller 76 and the sensor array 86 is mounted, forms part of a swingably mounted unit 101 having a plate 102 with a mounting portion 102*a* provided with an opening 102*b* for cooperating with the opening 18*a* in plate 18 for swingably mounting assembly 101. Assembly 101 has a cover lid portion 103 mounted upon a pair of spaced parallel side plates 102 and a plate (not shown) similar thereto, which lid rotatably mounts a fastening member 104 in a free-wheelingly fashion. The lower end of 104*a* of freewheeling mounted fastening member 104 is adapted to threadedly engage a tapped aperture 106*a* in block 106 which is secured between plate 18 and mounting plate 12 (see FIG. 1*b*). Thus, the swingably mounted assembly 101 serves to facilitate examination of the sensor array assembly as well as other internal mechanisms and/or components.

Lid 103 supports a group of spacer rods 108 which are secured at their upper ends to lid 103 and which position and support a printed circuit board 110 at their lower ends, said printed circuit board 110 supporting electronic components which cooperate with sensors 86*a* through 86*d* of the sensor arrary 86 for providing signals utilized for sheet examination and evaluation purposes, as will be more fully described.

The rollers 28, 32, 34, 38 and 74 are all driven by the feed motor Mf which, as was described hereinabove, is positioned between plates 12 and 14 and, considering FIG. 2, has its output shaft 112 extending through plate 14. A gear 114 and a double-pulley member 116 are mounted upon shaft 112. Gear 114 is provided with a plurality of gear teeth 114*a* about its periphery and is secured to the feed motor output shaft 112 to rotate in unison with shaft 112. A light source 118 and a light sensor element 120 are positioned on opposite sides of gear 114 adjacent to the periphery thereof whereby teeth 114*a* pass between members 118 and 120 to cause light from source 118 reaching sensor element 120 to be modulated in a pulse-like fashion for generating timing pulses to be employed in a manner to be more fully described.

The double pulley member 116 is provided with an integral pair of timing belt receiving grooves for receiving and supporting timing belts 120 and 124. As is conventional, the timing belts are provided with an interior surface having uniformly spaced transverse grooves 120*a* which are adapted to mesh with spaced projections, such as for example, the spaced projections 122*a* arranged in an annular groove about pulley 122.

Each of the remaining pulleys is of a similar design to prevent slippage between the pulleys and their associated timing belts. Thus, timing belt 120 is entrained about one recess in double pulley 116 and the recess provided in pulley 122. Timing belt 124 is entrained about the remaining recess in double pulley 116 and a first recess provided in a double pulley 126. Timing belt 128 is entrained about the remaining recess of double pulley 126 and one of the recesses in double pulley 130. The remaining recess in double pulley 130 is adapted to receive timing belt 132 which is entrained about the aforesaid remaining recess and a first recess in double pulley 134. A timing belt 136 is entrained about the remaining recess in double pulley 134 and a recess in pulley 138.

Double pulley 126 is mounted to rotate about shaft 144*a* and has a smaller diameter portion 126*b* which receives timing belt 124 and has a larger diameter portion 126*c* which receives timing belt 128. Similarly, double pulley 130 rotates about shaft 74*a*, has a smaller diameter portion 130*b* which supports timing belt 132 and larger diameter portion 130*c* which supports timing belt 128. Double pulley 134, which rotates about shaft 34*a*, has a large diameter portion 134*b* which receives timing belt 132 and has a smaller diameter portion 134*c* which receives timing belt 136. The diameters of each of the above-mentioned double pulley members are chosen so that the proper rotating speeds of each of the rollers associated with the pulleys is obtained. For example, the power train is designed to cause the picker roll to rotate at a speed which imparts movement to the document so as to be capable of achieving a velocity of 113 ips (inches per second). The feed roller 32 is rotated at a speed capable of moving documents along feed path 68 at a linear velocity of 106 ips. The acceleration roller 74 rotates at a speed sufficient to accelerate sheets so that they reach a velocity of 176 ips.

A limpness detector assembly 142 is located downstream from the light source and sensor array 84, 86, and is comprised of a pair of elongated generally cylindrical shaped members 144 and 146, each mounted to rotate about shafts 144*a* and 146*a* and each having a gear-like periphery 144*b* and 146*b* respectively. Shaft 146*a* is mounted upon a swingable arm (not shown) which is resiliently biased to normally urge gear-like roller 146 toward gear-like roller 144. As sheets pass therebetween, a counterforce is exerted upon gear-like rollers 144, 146, the magnitude of the counter-force being a function of the relative stiffness of relative limpness of sheets passing therebetween, thereby limiting the movement of gear-like member 146 toward gear-like member 144. Members 146 and 144 are mechanically coupled and driven so that the teeth of one of said gear-like rollers at least partially enters into the grooves arranged between the teeth of the other of said gear-like rollers and vice versa, in order to impart an undulating configuration to the sheet passing therebetween. The degree of said undulations is a function of the interaction between the force exerted upon the sheet by gear-like rollers 144 and 146 and the counter-force exerted by the sheet passing therebetween upon gear-like rollers 144 and 146. For example, very stiff sheets do not experience any bending, while extremely limp sheets such as onion-skin sheets, undergo a maximum amount of bending. A detailed description of the limpness detector is set forth in copending application Ser. No. 174,595 filed Aug. 1, 1980 and assigned to to the assignee of the present invention.

Double pulley member 126 is mounted upon common shaft 144*a* to impart rotation to gear-like roller 144. A suitable power train (not shown) couples shaft 144*a* to shaft 146*a* to assure substantially synchronised rotation of gear-like rollers 144 and 146 in order to assure the proper entry of the teeth of gear-like roller 144 into the grooves between teeth arranged between the teeth of the other gear-like roller 146, and vice versa.

A pair of elongated O-rings, only O-ring 152 being shown in FIG. 1, are entrained about pulleys 154, 156, 158, 160, 162 and 164. Another pair of O-rings, only one such O-ring 166 being shown in FIG. 1, are entrained about pulleys 160, 168, 170 and 172. Pulleys 154, 156, 158, 162, 164, 170, 168 and 172 are all freewheelingly mounted so as to be driven by O-rings 152 and/or 166. Pulleys 154, 156, 158, 160, 162, 168 and 172 are all mounted to rotate about shafts 154*a*, 156*a*, 158*a*, 122*b*, 162*a*, 172*a* and 168*a*, all of which are mounted in a stationary fashion so that they are capable only of rotating about their central axes.

Pinch rollers 164 and 170 are rotatably mounted upon shafts 165, 171 provided at the free ends of a pair of swingable levers 176 and 178 in a freewheeling manner, each being pivotally mounted to plate 12 by pivot pins 176*a* and 178*a* respectively. Centrally located pulleys 164*a* and 170*a* shown in dotted fashion are also freewheelingly mounted upon shafts 165, 171 and rotate independently of pinch rollers 164, 170. Pulleys 164*a*, 170*a* have recesses for receiving and supporting O-rings 152, 166. The diameter of pinch rollers 164, 170 is sufficient to prevent O-rings 152, 166 from engaging pinch rollers 190, 192 so that only pinch rollers 164, 170 engage such rollers 190, 192. The shafts 162*a*, 172*a* of pinch rollers 164, 170 and pulleys 164*a*, 170*a* are spaced apart to cause a slight separation between O-rings 152, 166 in the region 152*c*, 166*c* to allow the trailing edge of a sheet to be released as the leading edge of the same sheet is gripped between either pinch rollers 164, 190 or 170, 192.

As can best be seen from both FIGS. 1 and 2, the double pulley member 116, which is driven by the feed motor Mf, positively drives large diameter roller 160 which is mounted upon the common shaft 122*b* with pulley 122 and further drives roller 144 by means of belt 124.

The linear portion 152*a*, curved portion 152*b* and linear portion 152*c* of the path defined by O-ring 152, cooperates with the linear portion 166*a*, curved portion 166*b* and linear portion 166*c* of the path defined by O-ring 166 to cooperatively define a conveying path between which sheets exiting from the limpness detector assembly 142 are caused to be fed in a generally diagonally upward direction along path portions 152*a*, 166*a* and thereafter experiencing movement along a curved path portion 152*b*–166*b*, whereupon the documents are then moved in a generally downward vertical direction, as sheets move between path portions 152*c*–166*c*. Based upon the exemplary values set forth hereinabove, the sheets are moving at the same linear velocity through the path defined by the O-rings 152 and 166 as the sheets move through the limpness detector assembly 142 and the acceleration roller 74 and cooperating idlers 76, namely, 176 inches per second.

Considering FIG. 1, a pair of rollers 190 and 192 are mounted to rotate about shafts 190*a* and 192*a*. Centrally located pulleys 190*b*, 192*b*, similar to pulleys 164*a*, 170*a* are also mounted upon common shafts 190*a*, 192*a*, each of the pulleys 190*b*, 192*b* having entrained thereabout an O-ring 194, 196. O-rings 194 and 196 are seated in grooves in pulleys 190*b*, 192*b* provided at the central portion of the pinch rollers 190*b*, 192*b* and are further entrained about a directly driven large diameter pulley 198 and 200 respectively, each rotating about a shaft 198*a*, 200*a* respectively. The diameters of pinch rollers 190, 192 are greater than the diameters of pulleys 190*b*, 192*b* to prevent O-rings 194, 196 from engaging pinch rollers 164, 170 and/or O-rings 152, 156. Each of the pulleys 198, 200 has integrally joined thereto and extending from both sides thereof a pair of smaller diameter pulley portions so that the pulley 198 is arranged between the aforesaid smaller diameter pulley portions. Only one such small diameter pulley portion, namely portions 198*c* and 200*c*, is shown in FIG. 1 for purposes of simplicity, it being understood that each of these pulley portions receive and support an O-ring 202 and 204 which is further entrained about a cooperating pulley 206 and 208 respectively, each rotating about shafts 206*a* and 208*a* respectively.

The pulleys 198 and 200 further support rotary fan-like stacker wheels 209, 211 comprised of a plurality of curved resilient blades 211*a*, 211*b*, arranged at spaced intervals in the manner shown so as to form pockets 209*b*, 211*b* between adjacent pairs of resilient blades 209*a*, 211*a*. Each sheet is adapted to be driven into one of said pockets in a manner to be more fully described. The sheets are subsequently stripped from their pockets by O-rings 202 and 204 and thereafter deposited upon an associated stacking plate 216, 218, each having upright sides 216*a*, 216*b* and 218*a*, 218*b*, for supporting and gathering sheets thereon. Upright walls 216*b* and 218*b* are provided with clearance slots to prevent unimpeded movement of the runs 202*a*, 204*a*, or O-rings 202 and 204 respectively.

The manner in which the O-rings 194, 196 and rollers 190, 192, and pulleys 198, 200, 206 and 208 are rotated can best be understood from FIG. 2, wherein the shaft of stacker motor Ms shown at 220 has mounted thereon a double pulley member 222 having a larger diameter pulley portion 222*a* and a smaller diameter pulley portion 222*b*. A combination gear and pulley member 224 is mounted upon shaft 192*a*, while a combination gear and multiple pulley member 226 is mounted upon shaft 190*a*. An idler pulley 228 is mounted to free-wheelingly rotate about shaft 228*a*. Timing belt 230 is entrained about idler pulley 228, large diameter pulley portion 222*a*, pulley portion 224*a* of combination pulley-gear member 224, pulley portion 226*c* of combination pulley-gear member 226 and idler pulley 228. The direction of movement of timing belt 230 is represented by arrow 234.

A second timing belt 236 is entrained about pulley portion 226*a* of pulley-gear combination 226 and small diameter pulley portion 222*b* of double pulley 222. Pulley gear assemblies 224 and 226 are further provided with integral gear portions G1 and G2 which rotate in unison with their pulley portions and which mesh with one another in order to assure the synchronous rotation of these pulley members.

The small diameter pulley portions 224*b*, 226*d* of pulley gear assemblies 224 and 226 receive belts 240 and 242 which are further entrained about large diameter pulley portion 244*a* of pulley 244 and 246*a* of pulley 246. The small diameter portion 244*b* and 246*b* of double pulley members 244 and 246 receive timing belts 248 and 250, which are further entrained about pulleys 252 and 254 respectively which are mounted to rotate upon shafts 200*a* and 198*a* respectively.

The diameters of the respective pulleys are chosen in order to convey the sheets at the desired linear speeds during stacking. For example, the runs 194*a* and 196*a* of O-rings 194 and 196 are driven at a velocity designed to abruptly increase the velocity of sheets passing through the nip between rollers 164–190, and 170–192 to achieve a linear speed of the order of at least 178 ips in order to quickly "grab" the leading edge of a sheet after it has been deflected by the gating roller 250. The stacker wheels 209, 211 are mounted upon the shafts 198*a* and 200*a* which also rotatably support the pulleys 254 and 252 (see FIGS. 1 and 2), so that the tip speed at the free ends of curved flexible fingers 209*a* and 211*a* is of the order of 28 ips. The much higher linear speed of the sheets assures insertion of each sheet into a pocket 211*b* (209*b*). The curvature of the pocket serves to decelerate the sheet and hold it in position as it is moved to the stripping position.

A gating roller 250 mounted for rotation upon the gating roller motor shaft 252, is adapted to rotate in either a clockwise or counterclockwise direction, dependant upon the polarity of the driving signal applied to the gating motor Mg.

The gating motor Mg is preferably a d.c. motor capable of rotating at a speed in the range of 2,000 to 8,000 rpm and preferably of the order of at least 3,600 rpm, and which is capable of rapidly reversing direction and reaching its maximum rpm in the reverse direction within an extremely short time interval.

In order to be assured that sheets are deflected in the proper direction by gating roller 250, as will be more fully described hereinbelow, a pair of sensor elements 260 and 262 are arranged just downstream of pinch rollers 190 and 192. A pair of light sources 261 and 266, which may for example be light emitting diodes (LED) are arranged adjacent to the sensors 262, 260 respectively so that, as sheets pass therebetween as represented by arrows 272 and 270, the light rays from each source are attenuated by the presence of the sheet causing the reduced brightness condition detected by sensors 262 and 260 to be interpreted as the passage of a document, which information is utilized by computer control means 280, to control the operation of the apparatus.

The operation of the document handling examining and stacking system is as follows:

A stack of sheets which may, for example, be paper currency, are placed in the infeed hopper. See stack S of FIG. 1*a*. When the document handling apparatus 10 is turned on, the rotation of the eccentric picker roller 28 jogs the stack S upwardly and its O-rings (see O-ring 72) frictionally engage the bottommost sheet, accelerating the bottommost sheet in the forward feed direction 68 whereby the bottommost sheet is advanced through the tapering throat portion to move into the nip formed between stationary stripper member 62 and feed roll 32. Members 62 and 32 cooperate in the manner described hereinabove to assure that sheets are fed in a single file as they pass through the aforesaid nip between members 62 and 32 and are advanced in the feed direction shown by arrow 68. The sheets undergo a turn at rollers 42 and 34 and thereafter move in an upward diagonal direction shown by arrow 68*a*. The sheets are abruptly accelerated by acceleration roller 74 and cooperating idler 76 in order to form a gap between the trailing edge of the document accelerated by accelerator roll 74 and the leading edge of the next document to be fed therethrough, said gap being of a length sufficient to prevent overlapping between documents and thereby facilitating counting of documents.

As the sheets, which in the example given hereinabove, are moving at a linear speed of the order of 176 ips, they pass between lamp source 96 and sensor 94 and subsequently between sensor array 86 and light source 84. The signal conditions from the sensors of array 86 and from sensor 94 are fed to computer control 280. The type of tests performed on the sheets, which may for example be paper currency, are: density of the sheets, i.e. are they "clean" or "dirty"; do the sheets have tears, cuts, slits or perforations; are there folded or torn corners; and are the sheets of the proper length, i.e. are they too long or too short.

The limpness detection assembly 142 is designed to detect the relative limpness or stiffness of the sheets and is further designed to indicate the presence of foreign material or members affixed to the sheets, for example such as masking tape or transparent tape, staples and the like, which materials are sometimes used to repair a torn bill. The limpness detector assembly 142 also serves as a means for indicating the presence of folded corners, as well as erroneous double feeding of documents by providing a "too stiff" signal in the event of passage of two documents in an overlapping fashion. Signals from the limpness detector apparatus, which is described in detail in the aforementioned copending application Ser. No. 174,595 are also provided to computer control circuit 280 in order to control the apparatus in accordance with the test or tests being performed.

In addition to the above, it is also possible to provide a counterfeit detection apparatus 284 (FIG. 1*a*) which is positioned between the limpness detector assembly 142 and the sensor array 86, in order to detect the presence of suspect (i.e. possible counterfeit) bills. Counterfeit detection apparatus of this type is described in U.S. Pat. No. 4,114,804 issued Sept. 19, 1978 and assigned to the assignee of the present application. The counterfeit detection apparatus represented by black box 284 also provides its signals to one input of the computer control 280 which further receives signals from the post gate detectors 260 and 262 and which further provides control signals to the feed, stacker and gate motors Mf, Ms and Mg respectively.

The computer control 280 is provided with selection means 280*a*, 280*b* for example, adapted to select those tests which are to be performed, it being understood that none, all or less than all of the tests can be performed simultaneously depending upon the setting of the selection members 280*a*, 280*b*.

The first and second output stacking platforms 216 and 218 may arbitrarily be assigned to respectively stack, fit and unfit documents, fit documents being described as those which meet the desired critieria based upon the tests being performed, and unfit documents being those which fail to meet the desired criteria. For example, documents which are too limp and/or too stiff may be collected upon stacker plate 218 while documents that meet the desired criteria, i.e., fall between the criteria of being too stiff and too limp, are stacked upon stacker plate 216.

Based upon receipt of the appropriate information, computer control 280 is designed to apply a signal of the appropriate polarity to gating motor Mg in order to rotate the gating roller 250 in the proper direction. Let it be assumed that the last document tested is now entering into the sheet conveying path formed by O-rings 152 and 166, and that this sheet, in accordance with the signals applied to computer control 280, has been classified as unfit. Computer control 280 will therefore apply a signal to gating motor Mg at a time sufficiently in advance of the sheet entering into the conveying path formed by O-rings 152 and 166, to be assured that gating roller 250 reaches its desired operating speed before the leading edge of the document to be appropriately diverted reaches gating roller 250.

The path along which the next sheet to be diverted to the appropriate output stacker is moved, advances the sheet along a path 290 which lies substantially along an imaginary diameter 250*b* of gating roller 250 so that the leading edge of the sheet will strike the surface of gating roller 250 at an angle which is substantially perpendicular to an imaginary line which is tangent to the surface of gating roller 250 and which intersects path 290 at point 292. By rotating gating roller 250 at a sufficiently high speed (i.e. rpm), proper deflection of the document is made possible. For example, if the rotating speed is too low, since the sheet is moving at a very high rate of speed, in the example given 176 ips, the surface of roller 250 acts as a stationary wall and the sheet will simply bounce off of the surface of the gating roller 250 and will not be properly deflected. However, when the tangential speed of the gating roller 250 is sufficiently high and is much greater than the linear velocity of the sheet, it is thus possible to deflect the sheets in a rapid and effective manner. In the example given, the gating roller 250 is caused to rotate clockwise, deflecting the leading edge of the sheet toward the right and causing the sheet to move into the nip formed between pinch rollers 164, 190, which "grab" the sheet and cause it to be abruptly accelerated and moved through the nip and downwardly along the right-hand run 196*a* of O-ring 196 which serves as a means for moving sheets therealong as well as guiding said sheets toward and into the pockets 211*b* formed by adjacent pairs of fingers 211*a*. The O-ring 196 which may also be a flat belt, if desired, is formed of a resilient material having a relatively high coefficient of sliding friction which engages the sheet and serves to urge the leading edge of the sheet deeply into one of pockets 211*b* in stacker wheel 211. The curvature of each pocket 211*b*, defined by the curved fingers 211*a* serves to hold the sheet as the stacker wheel 211 rotates clockwise. The leading edge of the sheet in each pocket 211*b* bears against the right-hand run 204*a* of O-ring 204 which serves to strip the sheet from each pocket 211*b* as the inner ends of the fingers 211*a* begin to move past O-ring 204. Preferably an O-ring is placed opposite sides of each of the stacker wheels 209, 211. The stripped sheets are then caused to move downwardly where they are collected upon stacker plate 218. The leading edges of the sheets engage the right-hand run 204*a* of O-ring 204 which serves to drive the leading edges of the sheets downwardly to form a neat stack whereby the O-ring 204 serves the dual functions of stripping documents from the stacker wheel assembly 211 and serves to urge the leading edges of the documents downwardly towards the stacker plate 218.

Stacker wheel assembly 209, O-rings 194 and 202, and stacker plate 216, function in a manner identical to the corresponding elements 211, 196, 204 and 218 described hereinabove.

As was mentioned hereinabove, pinch rollers 164 and 170 are swingably mounted upon arms 176 and 178. The roller arms 176 and 178 are designed to rotate clockwise and counterclockwise respectively, as shown by arrows 294 and 296. In order to permit the clearing of any jam condition in the nips formed between rollers 164–190 and 170–192 respectively, arms 176, 178 are also free to swing in an over-center fashion in the event of a jam to provide an automatic arrangement for clearing a jam. Sensors in the form of microswitches 279 and 298 may be provided to indicate the release of swingable arms 176 and 178 form their operative position in order to provide indications to the computer control 280 to enable the computer control to take appropriate action.

The post gate sensors 260 and 262 function in a somewhat similar manner to provide signals to the computer control 280 in order to be assured that documents have been deflected in the proper direction by gating roller 250. Thus, for the example given hereinabove, assuming gating roller 250 to be rotating clockwise, computer control 280 will examine the signal derived from sensor 260 to be assured that a document has passed between sensor 260 and LED 264 at the proper time. In the event that this signal is not derived and/or an erroneous signal is derived from sensor 262, event though gating roller 250 is rotating clockwise, computer control 280 will interpret this data as an error condition and take appropriate action which may, for example, preferably take the form of deenergization of the feed motor Mf and the gating motor Mg, preferably allowing the stacker motor Ms to continue rotation to clear any documents from the region of gating roller 250.

The computer control 280 receives a signal from sensor 120 shown in FIG. 2 in order to provide proper timing for the apparatus. For example, assuming an ideal condition in which a local supply source provides an operating voltage of a precise voltage and frequency, all pulleys, belts and the like will be likewise rotating and moving at an ideal speed. However, in the event that there are any sudden surges and/or gradual changes in the operating voltage and/or frequency of the local source, and/or in the event that the motor undergoes an abrupt or gradual change in its operating characteristics, this will directly affect the operating speed of the aforesaid feed, stacker and gating motors Mf, Ms and Mg. However, by deriving timing pulses directly from one of said motors, namely the feed motor Mf, any changes, whether gradual or sudden, in the local supply source, are immediately reflected in the timing pulses developed off of timing gear 114 to assure proper operation of the apparatus due to the synchronous operation of the mechanical system and the system electronics.

The gating roller 250 is preferably a low mass member to facilitate its rapid acceleration and deceleration. To accomplish this, the gating roller 250 may assume a variety of configurations have low mass. One gating device suitable for this purpose is shown in FIG. 3*a* and is comprised of a bent wire member 306 having opposite end portions 306*b* and 306*c* arranged along the axis of rotation of the output shaft 252 for gating motor Mg. Central portion 306*a* is integrally joined to end portions 306*b* and 306*c* through radially aligned integral portions 306*d* and 306*e* and is thereby adapted to define a cylinder of revolution when rotating. The high rpm of the gating motor Mg, especially in relation to the linear speed of the sheets to be deflected, assures proper deflection of the sheets. The bent wire gating member 306 is of extremely low mass, and is capable of rapidly accelerating and decelerating to provide the high speed gating action necessary in the apparatus 10 of FIG. 1. End portions 306*b* and 306*c* are preferably mounted in suitable bearings 302 and 304.

As another alternative embodiment 307, bent wire members 306 and 306', substantially identical to bent wire member 306 of FIG. 3*a*, may be arranged so as to lie in a common imaginary plane, as shown in FIG. 3*b*. The ends 306*b* and 306*b'* and the ends 306*c* and 306*c'* of the bent wires 306 and 306' may be arranged within cylindrical bushings 308 and 310 respectively which, in turn, may be arranged within suitable bearings (not shown) to facilitate high speed rotation thereof. The operation of the embodiment 307 of FIG. 3*b* is substantially identical to that of FIG. 3*a* except for the fact that the central portions 306*a* and 306*a'* will wipingly engage the sheet to be deflected twice as often as compared with the single bent wire embodiment 306 of FIG. 3*a*.

FIG. 3*c* shows still another alternative embodiment 309 wherein bent wires 306 and 306' are arranged to lie in a first common plane and bent wires 306'' and 306''' are arranged to lie within a second common plane which may be perpendicular with the first common plane or, in fact, may form another angle with the first common plane, which angle may be greater than or less than 90°. The free ends of the bent wires 306 through 306''' are mounted within cylindrical bushings 308 and 310 in a manner similar to that shown for the embodiment 307 in FIG. 3*b*.

FIG. 4 shows still another embodiment 311 of the present invention in which a single wire 312 has its opposite ends securely fastened to first and second end discs 314 and 316. One technique for accomplishing this is to provide openings 314*a* and 316*a* in discs 314 and 316 for receiving the respective ends of wire 312. The free ends of wire 312 may be cemented or otherwise secured in place by a suitable cement, epoxy, adhesive, or the like. A stub shaft projects outwardly from each disc, disc 316 being shown as having an integral stub shaft 316*b* projecting outwardly for coupling to the gating motor. The disc 314 is also provided with a similar stub shaft 314*b*, which is preferably integrally formed with disc 314. In order to reduce the possibility of torsional stress, a central shaft 318 is provided and extends between and is integrally joined to discs 314 and 316, providing additional structural strength for the gating roller 311. Additional wires may be provided at spaced intervals about the gating roller assembly 311 and joined to discs 314 and 316 in a manner similar to that of wire 312. For example, wire 320, shown in dotted fashion, may be arranged to lie in a common imaginary plane extending through wire 312 and shaft 318. Obviously, additional wires may be mounted around the periphery of the gating roller assembly shown in FIG. 4, if desired.

FIGS. 5 and 5*a* show still another alternative embodiment 323 for the gating roller which is comprised of a pair of end discs 324 and 326 each having a stub shaft 324*a* and 326*a* respectively for being rotatably supported within suitable bearings and for coupling with the gating motor Mg. A pair of hollow, oblong members 328 and 330 have their opposite ends integrally joined to discs 324 and 326. The outer cylindrical shaped surfaces 328*a* and 330*a* engage the sheet to be deflected as the gating roller assembly 313 of FIG. 5 is rotated.

The interior curved convex surfaces 328*b* and 330*b* form a passageway 332 through the gating roller assembly 323 of FIG. 5 which has enlarged end portions 332*a* and 332*b* which taper to a narrow central portion 332*c*. This arrangement enables the gating roller assembly 323 to provide three paths of movement for sheets, namely a first deflected path due to the clockwise rotation of the gating roller; a second deflected path due to the conterclockwise rotation of the gating roller; and a third undeflected path wherein the gating roller through-opening 332 is maintained substantially in alignment with the path of movement of sheets represented by arrow 334. The manner in which this deflection technique is accomplished is described in greater detail hereinbelow.

The bent wire configurations of FIGS. 3*a* through 3*c* are all substantially identical to one another. However, other bent wire configurations may be employed, FIGS. 6*a* through 6*h* showing some of the preferred configurations.

Figure 6A:
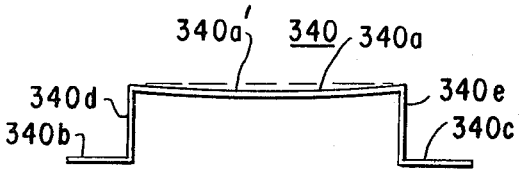
Figure 6B:
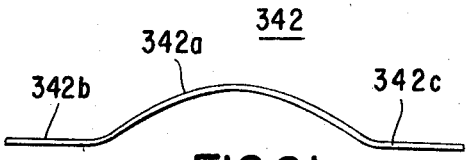

In the embodiment 340 of FIG. 6*a*, elements 340*b* through 340*e* are substantially identical to elements 306*b* through 306*e*. However, portion 340*a* differs from portion 306*a* in that it has a slightly curved concave contour. The curved concave contour is caused to assume a substantially linear contour as shown by dotted line 340*a*' due to the centrifugal force exerted upon central portion 340*a*, as a result of high speed rotation of the bent wire configuration 340.

In an effort to concentrate the mass of the rotating gating member as close to the axis of rotation as is possible, which further significantly reduces the time needed for accelerating the rotating gating member to the desired rpm., the bent wires employed in the embodiments of FIGS. 3*a* through 3*c* and 6*a*, may for example also be replaced by one of the embodiments shown in FIGS. 6*b* through 6*h*. For example, in the embodiment 342 of FIG. 6*b*, the central portion 342*a* is shown as having a curved shape whose opposing ends are bent to form mounting portions 342*b* and 342*c* which lie along a common axis and are adapted to be suitably supported within associated bearings for high speed rotation.

Figure 6C:
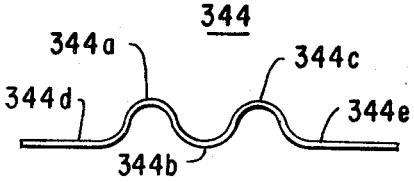
Figure 6D:
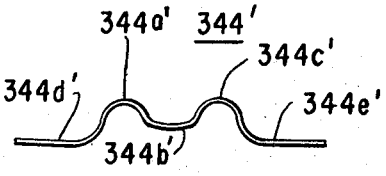

FIG. 6*c* shows an embodiment 344 having a central portion with an undulating configuration comprised of three integrally joined substantially U-shaped sections 344*a*, 344*b* and 344*c*, the ends of the wires 344*d* and 344*e* serving as the mounting means and lying along a common axis. The embodiment 344' of FIG. 6*d* is substantially the same as the embodiment 344 of FIG. 6*c*, except that the central portion 344*b*' is further removed from the axis of rotation of embodiment 344' as compared with embodiment of 344 of FIG. 6*c*. It should be understood that although three such U-shaped portions are shown, a greater or lesser number of U-shaped sections may be employed, if desired.

Figure 6E:
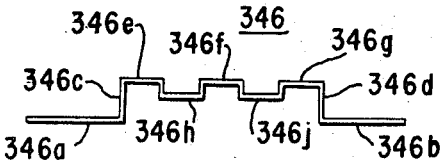

The embodiment 346 of FIG. 6*e* shows a wire which, although provided with a number of bends, is comprised of a plurality of linear sections between bends, forming end portions 345*a* and 346*b*, radially aligned portions 346*c* and 346*d* and a central portion having substantially U-shaped sections 346*e*, 346*f* and 346*g* integrally joined by the intermediate linear sections 346*h* and 346*j*. Obviously, a greater or lesser number of such U-shaped sections may be provided.

Figure 6F:
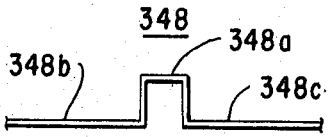
Figure 6G:
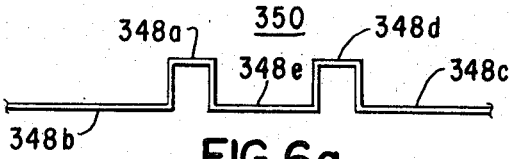

FIG. 6*f* shows embodiment 348 having a single U-shaped projection 348*a* centrally located between the ends 348*b* and 348*c* respectively. The embodiment 350 of FIG. 6*g* shows two such projections, 348*a* and 348*d*, joined by an intermediate linear section 348*e*.

Figure 6H:
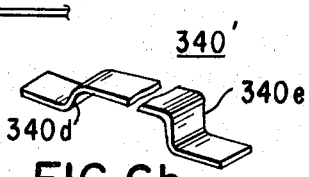

All the embodiments shown in FIGS. 6*a* through 6*g* utilize a bent wire which preferably has a circular cross-sectional configuration. In order to provide additional supporting strength, especially to the radially aligned portions of these bent wire members to prevent undue torsion stresses, the wire may be provided with a cross-sectional configuration as shown in FIG. 6*h*, wherein the embodiment 340' is substantially similar to the embodiment 340 shown in FIG. 6*a*, except that the cross-sectional configuration of the wire is an oblong shape which serves to significantly reduce torsional stress otherwise experienced by the radially aligned portions 340*d* and 340*e*. In a similar manner, the single wire 312 of the embodiment shown in FIG. 4 may be replaced by a wire having a cross-sectional configuration as shown in FIG. 6*h*.

The alternative embodiments of FIGS. 6*a* through 6*h* may be used in any of the configurations shown in FIGS. 3*a* through 3*c*, as well as FIG. 4.

The embodiments of FIGS. 3*a* through 6*h* show rotatable gating assemblies having a discontinuous periphery which engages sheets during rotation thereof for deflection purposes. The gating roller assembly may also have a substantially continuous surface as shown, for example, in the embodiment 360 of FIG. 7, provided with a preferably hollow cylindrical shell 362 having end portions 362*a* and 362*b*, each provided with stub shafts 362*c* and 362*d* respectively. The cylindrical surface may be covered with a random pile or brush-like or bristle-like surface 362*e*. One example is a Velcro-type material formed of nylon and having an adhesive backing for mounting on the surface of the cylindrical member. The material may be of either the hook type or the loop type Velcro. Velcro is a registered trademark.

FIG. 7*a* shows still another embodiment of a gating roller 364 which is comprised of a cylindrical shell 366 and a small diameter cylindrical shell 368 arranged in concentric fashion with cylinder 366 by means of the radially aligned ribs 370 integrally joined to the exterior surface of cylindrical shell 368 and to the interior surface of cylindrical shell 366. A shaft may be extended through cylindrical shell 368 and secured thereto by any suitable means. The exterior surface 366*a* of cylindrical shell 366 may be roughened, may have openings arranged along the surface, or may be covered with an abrasive material or a material having an abrasive surface which may, for example, be a material such as emery cloth, sand paper, or the like. Other lightweight materials may be employed such as, for example, a rubber or rubber-like sheet. A sheet of lightweight material such as cork may also be mounted upon the surface of the cylindrical shell 366. As another alternative, the cylindrical shell may be formed of low mass material such as a cork or cork-like material, or in fact a plastic material which, although being a solid cylinder as opposed to a cylindrical shell, is preferably formed of an open-celled material of extremely low mass. The cork roller may be a solid cylindrical member having a shaft extending therethrough or may have a significant portion of the central core removed therefrom to reduce the total mass of the gating roller.

FIG. 7*b* shows a gating roller embodiment 311' substantially similar to the embodiment 311 of FIG. 4, in which like elements are designated by like numerals. In addition to providing a single wire 312 (or a plurality of wires, if desired), the hollow portion of the gating roller 311' is filled with a resilient sponge-like material 315. FIG. 7*c* shows still another embodiment of a molded plastic member 420 having a substantially U-shaped configuration comprised of a yoke portion 422*a* provided with opening 422*b* for securement with the output shaft 252 of the gating motor Mg. A pair of elongted arms 422*c* and 422*d* are integrally joined to yoke portion 422*a* and preferably have curved convex contours along their outer surfaces. The interior portions of arms 422*c* and 422*d* each have a substantially gradually tapering contour, wherein the arms are tapered toward their free ends and build up in thickness toward the portions thereof integral with yoke 222*a*, especially as shown at 422*e* and 422*f*, to significantly reduce bending in this region during rotation and to provide good structural supporting strength for arms 422*c* and 422*d*. If desired, a cross-piece 424 provided with central opening 424*a* for receiving the motor shaft 252, is further provided with a pair of slots 424*b* and 424*c* for snap-fittingly receiving the enlarged rounded ends 422*g* and 422*h* provided at the free ends of arms 422*c* and 422*d* respectively. If desired, cross-piece 424 may be mechanically secured to or integrally formed with arms 422*c*, 422*d*.

The design of the embodiment 420 enables the rotary gating assembly to be simply and inexpensively molded of a suitable plastic material having good structural strength and low mass.

FIGS. *7d* and *7e* show gating members 349, 349' formed of a lightweight rugged plastic molded in the form of a rectangular sheet having rounded edges 349*d*, 349*e* and 349*d'*. Projections 349*a*, 349*b* and 349*a'*, 349*b'* serve as means for rotatably mounting members 349, 349'. The central portion 349*c* of member 349 may be removed to reduce the mass and/or to provide a three-way deflection device of the type shown in FIG. 8, for example. Notches 349*d''* in member 349' also serve to reduce the mass of member 349'.

As was described hereinabove, the embodiments of FIGS. 3*a* through 3*c* and FIG. 5 may be utilized to provide a gating roller assembly having the capability of gating sheets to any one of three outfeed paths for ultimate stacking thereof. As shown in FIG. 1, by rotating the gating roller clockwise, sheets are deflected so as to be ultimately stacked upon the right-hand stacking plate 218. By rotating gating roller 250 in a counter-clockwise direction, sheets are deflected to ultimately be collected upon a left-hand stacking plate 216. Considering FIG. 8 in which an end view of the embodiment 323 of FIG. 5 has been reproduced, by halting the gating motor Mg so that the through-opening 332 is in alignment with the path movement of sheets, designated by arrow 370, said sheets may then move undeflected through the aforesaid through-opening 332, to be collected in a third stacking location or for further processing, for example. Obviously, the length of the through-opening 332 measured along the longitudinal axis of the gating roller, is designed to be greater than the width of a sheet passing therethrough to permit unimpeded movement of a sheet along the undeflected path when the through-opening 332 of the gating roller is aligned in the manner shown with the undeflected path 370. In order to accomplish this result, a code disc 380 is mounted on a common shaft 382 with gating roller 323. The code disc 380 is provided with a pair of arcuate slits 380*a* and 380*b*. Light sources 384 and 386 are positioned to one side of disc 380 and light sensing elements 388 and 390 are positioned to the opposite side of code disc 380. Arcuate slots 380*a* and 380*b* are substantially aligned with the surface portions 328 and 330 of gating roller 323 so that when the gating roller 323 is in the position shown in FIG. 8, light passes through the arcuate slots 380*a* and 380*b* from light sources 384 and 386 to activate sensors 388 and 390. The outputs of these sensors are coupled to a gate 392 which provides an output only in the absence of light. In the event that the gating roller 323 is improperly aligned, the arcuate slots 380*a* and 380*b* will be displaced from sensors 388 and 390. The braking means 394 provides a signal at its output 394*a* to the gating motor Mg to halt the gating motor. A signal is also developed at output 394*b* to close switch 396 and provide an electrical path between the positive voltage source through closed switch 396 to lamps 384 and 386.

When the gating roller is aligned in the proper undeflected position, the arcuate slots 380*a* and 380*b* are offset from the light sources 384 and 386, preventing light from reaching sensors 388 and 390. when the gating roller 323 is offset from the desired undeflected position after having been brought to a halt, at least a portion of the arcuate slots 380*a* and 380*b* will be aligned with light sources 384 and 386 causing light to reach one or both of the sensors 388 and 390, coupling a trigger pulse to a circuit such as, for example, a one-shot multi-vibrator 398 which develops a square pulse at its output 398*a* for application to braking means 394 to release the braking means 394 from braking the gating motor Mg and to simultaneously apply a pulse to the gating motor Mg to incrementally advance the gating motor. The pulse developed by one-shot multi-vibrator 398 is preferably of a length sufficient to provide proper alignment of the gating roller through-opening 323 with path 370. Although the apparatus of FIG. 8*a* has been described in connection with the gating roller 323, it should be understood that any of the gating roller designs of FIGS. 3*a* through 3*c* may be employed with equal success to move sheets to any one of three possible output paths. The embodiment of FIG. 4 may also be employed with the apparatus of FIG. 8*a* by omitting central shaft 318 or enlarging the diameter of shaft 318 and providing a through-opening similar to through-opening 332. In addition, the through-opening 332 of the embodiment 323 shown in FIGS. 5 and 5*a* may be increased in size to reduce the alignment requirements by reducing the peripheral surfaces of the shelves 328 and 330.

Considering the embodiment of FIG. 1, the gating roller 250 may be arranged with a plurality of similar gating rollers set up in a "tree-circuit" fashion wherein the single gating roller 250 may deflect sheets moving along path 290 to either path 270 or path 272. As shown in FIG. 8*b*, two additional gating rollers 250' and 250'' are arranged to intercept and deflect sheets moving along the deflected paths 270 and 272, respectively, to enable gating rollers 250' and 250'' to deflect sheets to any one of the four paths 406, 408, 410 and 412. Obviously, a greater or lesser number of gating rollers may be used to deflect sheets to one of a greater or lesser number of paths for either final stacking or further processing, if desired.

A latitude of modification, change and substitution is intended in the foregoind disclosure and, in some instances, some features of the invention will be employed without a corresponding use of other features. Accordingly, it is appropriate that the appended claims be construed broadly and in a manner consistent with the spirit and scope of the invention herein.

What is claimed is:

1. Means for selectively diverting sheets comprising:

delivery means engaging the opposing major faces of sheets for delivering sheets in a single file along a substantially linear path in a spaced apart fashion towards a diverting location as each sheet leaves said delivery means;

elongated revolvable means positioned in said linear path of movement of said sheets and revolvable about an axis lying in said path of movement;

said delivery means including first and second moving guide means arranged adjacent one another for engaging opposing major faces of sheets along a portion of said linear path and extending abruptly away from one another at a point where the sheets leave the influence of said guide means, the portions of the first and second guide means extending away from each other serving as moving guides on opposite sides of said revolvable means;

means for continuously rotating said revolvable means in a first direction at high speed for diverting sheets engaging the periphery of said revolvable means in a first direction away from said linear path and towards said first guide means and for continuously rotating said revolvable means in a second direction at high speed for diverting sheets engaging the periphery of said revolvable means in a second direction away from said linear path and towards said second guide means;

first and second acceleration means forming a nip positioned adjacent said first and second moving guide means and downstream of said revolvable means, for abruptly accelerating a sheet as its leading edge enters the nip for delivery to a collection location associated with each acceleration means;

the nips of said accelerating means each being arranged to selectively receive the leading edge of a sheet, while its trailing edge is still between the first and second moving guide means;

said moving guide means being arranged relative to one another to exert a driving force upon sheets which gradually decreases over said portion of said linear path, enabling the acceleration means to accelerate a sheet whose leading edge has entered the nip of the acceleration means before the trailing portion of the sheet leaves said linear path portion, where it is engaged by said first and second moving guide means.

2. The diverting means of claim 1, wherein said acceleration means rotate independently of said guide means and abruptly accelerate sheets as they engage the accelerating means, wherein said first and second accelerating means each comprises a pair of cooperating pinch rollers and means for rotating one of said pair of pinch rollers.

3. The diverting apparatus of claim 2 wherein one pinch roller in each of said pairs of pinch rollers is swingably mounted between a first position engaging the other pinch roller of said pair and a second position displaced from the other pinch roller of said pair.

4. The diverting means of claim 1, wherein said acceleration means are spaced sufficiently from their associated moving guide means to operate independently of said first and second moving guide means for accelerating sheets to a linear speed greater than the linear speed of said first and second moving guide means.

5. The diverting apparatus of claim 4, wherein said guide means comprise moving belt means.

6. The diverting apparatus of claim 1 wherein said delivery means comprises first and second groups of roller means and means for rotating at least one roller means in each group;

first and second belt means being respectively entrained about said first and second groups of roller means which latter means are positioned to arrange first portions of said belt means to cooperatively enable said belt means to grip and convey sheets therebetween.

7. The diverting apparatus of claim 6 wherein second portions of said first and second belt means are arranged to diverge from one another to form said moving guide surfaces extending toward said first and second acceleration means.

8. The diverting apparatus of claim 7 wherein said first and second acceleration means each comprise a pair of cooperating pinch rollers and means for rotating one of said pinch rollers wherein each pinch roller pair comprises a drive pinch roller and at least one driven pinch roller.

9. The diverting apparatus of claim 8 wherein one of the roller means of said first and second groups of roller means is mounted on a common axis of rotation with the driven pinch roller of said first and second pairs of cooperating pinch rollers, said roller means and said driven pinch roller arranged on said common axis being rotatable independently of one another; the said one roller means engaging the belt means having a smaller diameter than the driven pinch roller sharing said common axis to prevent said first and second belt means from engaging the associated drive pinch roller.

10. The diverting apparatus of claim 6 wherein second portions of said first and second belt means are arranged to diverge from one another to form moving guide surfaces defining a V-shape and extending toward said first and second acceleration means;

cooperating roller means being provided at the point where said first and second belt means diverge from one another to aid said first and second belt means in feeding sheets along said first path.

11. The diverting apparatus of claim 10 wherein said cooperating roller means are arranged a spaced distance apart to cause the first and second belt means entrained about said cooperating roller means to exert a gripping force on a sheet moving therebetween which is smaller than the gripping force on the same sheet by said accelerating means to enable the acceleration means receiving said same sheet to accelerate said same sheet even though it is still being gripped by said first and said second belt means, said same sheet experiencing some slippage relative to said first and second belt means to permit acceleration of said same sheet means without being unduly stretched or torn.

12. The diverting means of claim 1 further comprising sensor means for detecting the passing of sheets along each of said first and second directions and means responsive to the failure of said sensor means to detect the passage of a sheet in the proper direction for halting operation of said acceleration means.

13. The diverting means of claim 1 wherein said revolvable means comprises a cylindrical shaped member formed of a low mass material.

14. The diverting means of claim 13 wherein said member is formed of cork.

15. The diverting means of claim 13 wherein said member is formed of plastic.

16. The diverting means of claim 15 wherein said cylindrical shaped member is substantially hollow.

17. The diverting means of claim 13 wherein the periphery of said member is roughened.

18. The diverting means of claim 13 wherein the periphery of said member is covered with a brush-like surface.

19. The diverting means of claim 13 wherein the periphery of said member is covered with an emery cloth.

20. The diverting means of claim 1, wherein said first and second acceleration means are comprised of rollers whose diameters are substantially equal to the diameter of said revolvable means.

21. Means for selectively diverting sheets comprising:

delivery means engaging the opposing major surfaces of said sheets for delivering sheets in a single file along a substantially linear path in spaced apart fashion toward a diverting location;

elongated revolvable means positioned in the aforesaid linear path of movement of said sheets and revolvable about an axis line along said path;

means for continuously rotating said revolvable means in a first direction at high speed for diverting sheets engaging said revolvable means in a first direction away from said path and for continuously rotating said revolvable means in a second direction at high speed for diverting sheets engaging said revolvable means in a second direction away from said path;

first and second accelerating means arranged downstream relative to said revolvable means for receiving leading edges of sheets respectively diverted in one of said first and second directions after the leading edge has passed beyond said revolvable means for abruptly accelerating sheets diverted thereto away from said revolvable means;

first and second rotary stacker wheel assemblies each having a plurality of curved resilient fingers being arranged to form pockets to receive a sheet delivered from an associated one of said accelerating means between adjacent ones of said fingers;

closed loop belt means extending between said first and second acceleration means and said first and second stacker wheel assemblies for guiding sheets from said first and second acceleration means toward their associated stacker wheel assemblies and being moved by an associated one of said first and second acceleration means for urging sheets engaging the closed loop belt means into one of said pockets.

22. The diverting means of claim 21, further comprising a stacking plate for said sheets;

closed loop stacking belt means extending between said stacking plate and said stacker wheel assembly and means for moving said stacking belt means for stripping sheets from the pockets of said stacker wheel assemblies as the fingers move past said stacking belt means and for urging the leading edges of sheets engaging said stacking belt means towards said stacking plate.

23. Means for selectively diverting sheets toward one of a plurality of paths comprising:

means for moving sheets in a single file in spaced apart fashion along a first path;

first and second collection means;

revolvable means and means for revolving said revolvable means in a first direction for diverting sheets away from said first path and toward said first collection means when said revolvable means rotates in a first direction and for revolving said revolvable means in a second direction to divert sheets moving along said first path toward said second collection means when said revolvable means rotates in a second direction, the axis of rotation of said revolvable means being aligned with said first path; and said revolvable means comprising an elongated member having a generally cylindrical shape;

the length of said member being greater than the width of the sheets delivered thereto;

said member having an elongated slot extending therethrough and being at least as long as the width of the sheets being delivered thereto, and being coincident with an imaginary diameter of said elongated cylindrical member, the width of said elongated slot at opposed surfaces of said elongated member being sufficient to facilitate entry of a sheet therethrough, enabling sheets to move substantially along said first path unimpeded by said member when said member is at rest and is oriented at a predetermined angle, so that said elongated slot is aligned with said linear path.

24. Means for selectively diverting sheets toward one of a plurality of paths comprising:

means for moving sheets in a single file in spaced apart fashion along a first path;

first and second collection means;

revolvable means and means for revolving said revolvable means in a first direction for diverting sheets away from said first path and toward said first collection means when said revolvable means rotates in a first direction and for revolving said revolvable means in a second direction to divert sheets moving along said first path toward said second collection means when said revolvable means rotates in a second direction, the axis of rotation on said revolvable means being aligned with said first path; and said revolvable means comprising a member having a shape enabling sheets to move substantially along said first path unimpeded by said member when said member is at rest and is oriented at a predetermined angle;

said revolvable means being a wire.

25. Means for selectively diverting sheets toward one of a plurality of paths comprising:

means for moving sheets in a single file in spaced apart fashion along a first path;

first and second collection means;

revolvable means and means for revolving said revolvable means in a first direction for diverting sheets away from said first path and toward said first collection means when said revolvable means rotates in a first direction and for revolving said revolvable means in a second direction to divert sheets moving along said first path toward said second collection means when said revolvable means rotates in a second direction, the axis of rotation on said revolvable means being aligned with said first path; and said revolvable means being an elongated wire bent to form a central portion displaced from an axis of rotation and at least one end portion arranged along the axis of rotation.

26. The apparatus of claim 25 wherein said central portion is curved.

27. The apparatus of claim 25 wherein said central portion has a plurality of undulations.

28. Means for selectively diverting sheets toward one of a plurality of paths comprising:

means for moving sheets in a single file in spaced apart fashion along a first path;

first and second collection means;

revolvable means and means for revolving said revolvable means in a first direction for diverting sheets away from said first path and toward said first collection means when said revolvable means rotates in a first direction and for revolving said revolvable means in a second direction to divert sheets moving along said first path toward said second collection means when said revolvable means rotates in a second direction, the axis of rotation on said revolvable means being aligned with said first path; and said revolvable means comprising a member having a shape enabling sheets to move substantially along said first path unimpeded by said member when said member is at rest and is oriented at a predetermined angle;

said revolvable means comprising a pair of wires.

29. The apparatus of claim 28, wherein each of said wires has end portions substantially aligned with the axis of rotation of said revolvable means and a central portion displaced from said axis of rotation.

30. Means for selectively diverting sheets toward one of a plurality of paths comprising:

means for moving sheets in a single file in spaced apart fashion along a first path;

first and second collection means;

revolvable means and means for revolving said revolvable means in a first direction for diverting sheets away from said first path and toward said first collection means when said revolvable means rotates in a first direction and for revolving said revolvable means in a second direction to divert sheets moving along said first path toward said second collection means when said revolvable means rotates in a second collection, the axis of rotation on said revolvable means being aligned with said first path; and said revolvable means comprising a member having a shape enabling sheets to move substantially along said first path unimpeded by said member when said member is at rest and is oriented at a predetermined angle;

said revolvable means comprising a plurality of wires.

31. Means for selectively diverting sheets toward one of a plurality of paths comprising:

means for moving sheets in a single file in spaced apart fashion along a first path;

first and second collection means;

revolvable means and means for revolving said revolvable means in a first direction for diverting sheets away from said first path and toward said first collection means when said revolvable means rotates in a first direction and for revolving said revolvable means in a second direction to divert sheets moving along said first path toward said second collection means when said revolvable means rotates in a second direction, the axis of rotation on said revolvable means being aligned with said first path; and said revolvable means comprising a substantially flat rectangular-shaped sheet of a material of low mass.

32. The apparatus of claim 31 wherein said sheet has portions thereof removed to reduce the mass of said sheet.

33. The apparatus of claim 31 wherein the central portion of said sheet is removed.

34. Means for selectively diverting sheets towards one of a plurality of paths comprising:

means for moving sheets in a single file in spaced apart fashion along a first path;

first and second collection means;

revolvable means and means for revolving said revolvable means in a first direction for diverting sheets away from said first path and toward said first collection means when said revolvable means rotates in a first direction and for revolving said revolvable means in a second direction to divert sheets moving along said first path toward said second collection means when said revolvable means rotates in a second collection, the axis of rotation on said revolvable means being aligned with said first path; and said revolvable means comprising a substantially U-shaped member having a pair of arms extending outwardly from a yoke portion, said yoke portion having means for rotatably mounting said U-shaped member.

35. The apparatus of claim 34 further comprising a bracing member secured to the free ends of said pair of arms.

36. Means for selectively diverting sheets towards on of a plurality of paths comprising:

means for moving sheets in a single file in spaced apart fashion along a first path;

first and second collection means;

revolvable means and means for revolving said revolvable means in a first direction for diverting sheets away from said first path and toward said first collection means when said revolvable means rotates in a first direction and for revolving said revolving means in a second direction to divert sheets moving along said first path toward said second collection means when said revolvable means rotates in a second collection, the axis of rotation on said revolvable means being aligned with said first path; and said revolvable means comprising a member having a shape enabling sheets to move substantially along said first path unimpeded by said member when said member is at rest and is oriented at a predetermined angle;

said revolvable means comprising a substantially cylindrical shaped member having an elongated through-opening extending therethrough and aligned with a diameter of said member for enabling sheets to pass through said member when said member is at rest and said through-opening is aligned with said path.

37. The apparatus of claim 36 further comprising means for aligning said through-opening with said path responsive to an undeflected request signal for moving sheets along said first path through said member.

38. Apparatus for stacking sheets comprising:

delivery means for delivering sheets along a path in a single file spaced apart fashion;

a rotary stacker wheel assembly having a plurality of curved resilient blades forming curved pockets between adjacent blades for receiving sheets;

closed loop belt means and pulley means supporting said belt means between said delivery means and the axis of rotation of said stacker wheel assembly;

means for rotating said pulley means for moving one run of said belt means along said path and in the direction of movement of sheets along said path to guide and urge sheets engaging said one run of said belt means towards said stacker wheel assembly.

39. The apparatus of claim 38 further comprising a stacker plate for receiving sheets from said stacker wheel assembly;

second closed loop belt means and second pulley means supporting said second belt means between said stacker plate and the axis of rotation of said stacker wheel assembly;

means for moving said second pulley means for moving one run of said second belt means in a direction towards said stacker plate, said one run of said second belt means acting to strip sheets from the pockets of said stacker wheel assembly as the resilient blades move past said one run of said second belt means and to urge the leading edges of sheets engaging the said one run of said second belt means toward said stacker plate to aid in the neat, compact stacking of sheets on said stacker plate.

* * * * *

UNITED STATES PATENT AND TRADEMARK OFFICE

CERTIFICATE OF CORRECTION

PATENT NO. : 4,420,153

DATED : December 13, 1983

INVENTOR(S) : Theodore Winkler, Frank J. Reed

It is certified that error appears in the above-identified patent and that said Letters Patent is hereby corrected as shown below:

In the specification

Column 4, line 24 change "inevntion" to --invention--
Column 12 line 17 change "(LED)" to --(LEDs)--
Column 14 line 58 change "form" to --from--
Column 17 line 37 change "345a" to --346a--
Column 20 line 40 change "foregoind" to --foregoing--
Column 9 line 3 change "large" to --larger--

Signed and Sealed this

*Seventh* Day of *May 1985*

[SEAL]

*Attest:*

DONALD J. QUIGG

*Attesting Officer* *Acting Commissioner of Patents and Trademarks*